US006830878B2

(12) United States Patent
Fyson

(10) Patent No.: US 6,830,878 B2
(45) Date of Patent: Dec. 14, 2004

(54) PARTIALLY OXIDIZED POLYALKYLENEIMINE ANTIOXIDANT FOR PHOTOGRAPHIC DEVELOPERS

(75) Inventor: John R. Fyson, Hackney (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/695,677

(22) Filed: Oct. 29, 2003

(65) Prior Publication Data

US 2004/0121271 A1 Jun. 24, 2004

(30) Foreign Application Priority Data

Dec. 19, 2002 (GB) ..... 0229557

(51) Int. Cl.[7] ..... G03C 7/413; G03C 5/305
(52) U.S. Cl. ..... 430/490; 430/450; 430/943
(58) Field of Search ..... 430/490, 450, 430/943

(56) References Cited

U.S. PATENT DOCUMENTS

| | | | | |
|---|---|---|---|---|
| 4,252,892 A | 2/1981 | Case | ..... | 430/357 |
| 5,466,565 A | 11/1995 | Shigemori et al. | ..... | 430/444 |

FOREIGN PATENT DOCUMENTS

| | | |
|---|---|---|
| EP | 0 924 293 | 6/1999 |
| WO | 01/36500 | 5/2001 |

OTHER PUBLICATIONS

Abstract of JP363104049A, May 9, 1988.*

* cited by examiner

*Primary Examiner*—Hoa Van Le

(74) *Attorney, Agent, or Firm*—Lynne M. Blank

(57) ABSTRACT

The present invention relates to a developer comprising a developing agent and a polyalkyleneimine antioxidant being formed by the condensation of a number of alkyleneimine units and having the following formula (I):

(I)

wherein $R_1$, $R_2$ and $R_3$ independently represent an unsubstituted or substituted alkylene group or $R_2$ may be H;

x and y independently represent an integer from 1 to 39,999;

the sum of x and y represents an integer from 10 to 40,000; and wherein the amine groups of the antioxidant have been partially oxidized with hydrogen peroxide or a compound capable of generating hydrogen peroxide, prior to the introduction of the developing agent.

In a preferred embodiment, the antioxidant has been partially oxidized such that the amount of hydroxylammonium groups formed is less than half the total equivalent of the original amine before the addition of the developing agent. The developer may optionally comprise an alkaline buffer.

14 Claims, 3 Drawing Sheets

PARTIALLY OXIDIZED POLYALKYLENEIMINE ANTIOXIDANT FOR PHOTOGRAPHIC DEVELOPERS

FIELD OF THE INVENTION

The present invention relates to photographic processing compositions, in particular a partially oxidized polyalkyleneimine antioxidant for use in photographic developer that is as stable as present systems and odour-free.

BACKGROUND OF THE INVENTION

The fundamental step of photographic processing is development. Development is carried out using a developing agent. The developing agent reduces silver halide to form silver. This silver gives the black-and-white image. The developing agents are oxidized by oxygen in the air and conventionally an antioxidant is added to the developer to reduce this unwanted reaction.

The fundamental steps in colour photographic processing include a colour developing step and a silver removal step. In the colour developing step, photographic colour developing compositions are used to process colour photographic materials such as colour photographic films and papers to provide the desired colour images. Such compositions generally contain colour developing agents, for example, 4-amino-3-methyl-N-(β-methane sulfonamidoethyl)aniline and other p-phenylenediamines, as reducing agents to react with exposed silver halide to form oxidized colour developer as well as silver. The oxidized colour developer goes on to react with suitable colour forming couplers in the colour photographic materials to form the desired dyes. However, such colour developing agents are susceptible to oxidation by dissolved oxygen from the air and an antioxidant is conventionally included in the colour developer compositions to preserve the oxidation state of the colour developing agent and thereby maintain useful colour developer activity.

Developing compositions are carefully formulated with various additives to overcome various problems besides the problems arising with developing agent oxidation. Thus, metal ions, various sequestering agents, surfactants and other components have been added over the years to provide the stability and photographic activity that is critical to the industry.

Current colour paper developers are often stabilized against aerial oxidation by the inclusion of an antioxidant, N, N diethylhydroxylamine, (hereinafter DEHA), which may work by reducing any 4-(N-ethyl-N-2-methanesulfonylaminoethyl)-2-methylphenylenediamine sesquisulfate (Kodak Colour Developing Agent CD3, hereinafter CD3) that is oxidized by air and by reacting with dissolved oxygen directly. This particular antioxidant compound has some problems associated with it, for example, it is volatile and produces an unpleasant smell in use.

U.S. Pat. No. 4,252,892 teaches the use of alkyleneimine polymers, especially ethyleneimine polymers, also known as polyethyleneimines, as antioxidants in a colour developer composition. While polyethyleneimines work well after a time, initially there is a rapid loss of colour developing agent.

U.S. Pat. No. 5,466,565 teaches the use of polymeric hydroxylamines as antioxidants in a colour developer composition. The generation of these hydroxylamines from polyalkyleneimines by their reaction with quantitative amounts of hydrogen peroxide at elevated temperatures is described.

PROBLEM TO BE SOLVED BY THE INVENTION

There remains a need for a suitable chemical solution developer that provides stability that equals or is better than the current system used and that is odour-free.

SUMMARY OF THE INVENTION

It has been found that only partial oxidation is necessary at room temperature to get good antioxidant effects from a polyalkyleneimine. This is a less expensive alternative, is easier to carry out, requires less energy, and in principle, would give more antioxidant effect for a given weight of material, resulting in an antioxidant with a longer life.

The present invention relates to a developer comprising a developing agent and a polyalkyleneimine antioxidant being formed by the condensation of a number of alkyleneimine units and having the following formula (I):

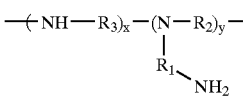

(I)

wherein $R_1$, $R_2$ and $R_3$ independently represent an unsubstituted or substituted alkylene group or $R_2$ may be H;

x and y independently represent an integer from 1 to 39,999;

the sum of x and y represents an integer from 10 to 40,000; and wherein the amine groups of the antioxidant have been partially oxidized with hydrogen peroxide or a compound capable of generating hydrogen peroxide, prior to the introduction of the developing agent.

In a preferred embodiment, the antioxidant has been partially oxidized such that the amount of hydroxylammonium groups formed is less than half, preferably less than a quarter, the total equivalent of the amine groups of the antioxidant before the addition of the developing agent. In another preferred embodiment, the developer further comprises an alkaline buffer. Preferably the developer is a colour developer comprising a colour developing agent.

ADVANTAGEOUS EFFECT OF THE INVENTION

The present invention includes several advantages, not all of which are incorporated in a single embodiment. The developer of the present invention equals or is better than one of the current systems used with respect to solution stability and pH stability. The developer of the present invention is an odour-free developer and is no more expensive to manufacture than current developers, when made on a large scale. The developer of the present invention also has very similar sensitometric effects to the current antioxidant, DEHA. In addition, the developer of the present invention has a similar effect on sensitometry as a solution free of antioxidant. The latter allows for more efficient use of silver in paper, which can result in a capability to make a paper that is cheaper to manufacture. The developer of the present invention comprises a polyalkyleneimine antioxidant, especially a polyethyleneimine antioxidant, (hereinafter EIP), that is environmentally acceptable and is not likely to pose a significant risk to health.

DETAILED DESCRIPTION OF THE INVENTION

Figure 1:
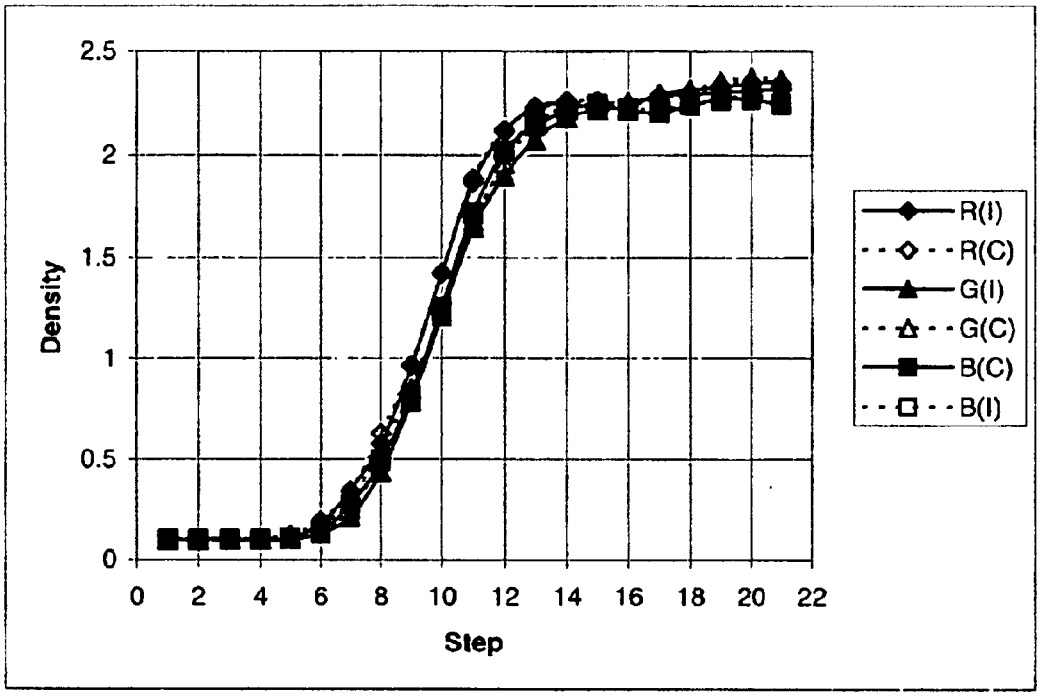
FIG. 1 represents a comparison of the sensitometry of a colour paper processed in a developer made with DEHA (control C) and a developer made according to the invention (I).

The composition of this invention contains one or more developing agents, preferably colour developing agents, and one or more antioxidants for the developing agent. The composition may further comprise a buffering compound.

The colour developer used for the present invention may utilize any of the generally used primary aromatic amine type colour developing agents. The primary aromatic amino colour developing agents that can be utilized in the compositions and methods of this invention are well known and widely used in a variety of colour photographic processes. They include aminophenols and p-phenylenediamines. They are usually used in the salt form, such as the hydrochloride or sulfate, as the salt form is more stable than the free amine, and are generally employed in concentrations of from 0.1 to 20 g/l of developing solution, more preferably from 0.5 to 10 g/l of developing solution.

Examples of aminophenol developing agents include o-amino-phenol, p-aminophenol, 5-amino-2-hydroxytoluene, 2-amino-3-hydroxytoluene and 2-hydroxy-3-amino-1,4-dimethylbenzene. Particularly useful primary aromatic amino colour developing agents are the p-phenylenediamines and especially the N,N-dialkyl-p-phenylenediamines in which the alkyl groups or the aromatic nucleus can be substituted or unsubstituted. Examples of useful p-phenylenediamine colour developing agents include: N,N-diethyl-p-phenylenediamine monohydrochloride, 4-N-N-diethyl-2-methylphenylenediamine hydrochloride, N,N-diethyl p-phenylenediamine sulfate (KODAK Colour Developing Agent CD2), CD3, 4-(N-ethyl N-hydroxyethylamino)-2-methylaniline sulfate (KODAK Colour Developing Agent CD4), 4-(N-ethyl-N-2-hydroxyethyl)-2-methylphenylenediamine sulfate and 4-N,N-diethyl-2,2-methanesulfonylaminoethylphenylenediamine hydrochloride, especially (CD2), (CD3) and (CD4).

An especially preferred class of p-phenylenediamine developing agents is one containing at least one alkylsulfonamidoalkyl substituent attached to the aromatic nucleus or to an amino nitrogen, such as, for example, 4-amino-3-methyl-N-(2-methanesulfonamidoethyl)aniline sulfate. Other especially preferred classes of p-phenylenediamines are the 3-alkyl-N-alkyl-N-alkoxyalkyl-p-phenylenediamines and the 3-alkoxy-N-alkyl N-alkoxyalkyl-p-phenylene-diamines. These developing agents are described in U.S. Pat. Nos. 3,656,950 and 3,658,525, and can be represented by the formula:

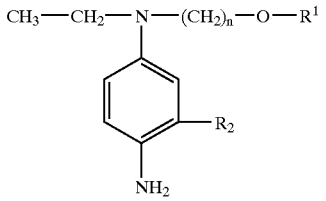

wherein n is an integer having a value of from 2 to 4, $R^1$ is an alkyl group having from 1 to 4 carbon atoms and $R^2$ is an alkyl group having from 1 to 4 carbon atoms or an alkoxy group having from 1 to 4 carbon atoms. Illustrative examples of these developing agents include the following compounds: N-ethyl-N-methoxy-ethyl-3-methyl-p-phenylenediamine, N-ethyl-N-methoxybutyl-3-methyl-p-phenylenediamine, N-ethyl-N-ethoxyethyl-3-methyl-p-phenylenediamine, N-ethyl-N-methoxyethyl-3-n-propyl-p-phenylene-diamine, N-ethyl-N-methoxy-ethyl-3-methoxy-p-phenylenediamine and N-ethyl-N-butoxyethyl-3-methyl-p-phenylenediamine.

Additional preferred developing agents include, but are not limited to, p-hydroxyethylethylaminoaniline sulfate, hydroquinone, a pyrazolidinone, a sulfonhydrazide or a hydrazine and others readily apparent to one skilled in the art.

The developer for use in the present invention may contain various ingredients which are normally contained in a developer, such as, for example, various alkaline agents such as potassium hydroxide, sodium hydroxide, potassium carbonate, sodium carbonate, potassium phosphate and sodium phosphate, various sulfites, hydrogensulfites and metahydrogensulfites including sodium sulfite, potassium sulfite, sodium hydrogensulfite, potassium hydrogensulfite, metasodium hydrogensulfite and metapotassium hydrogensulfite, various halogenides including potassium chloride, sodium chloride, potassium bromide, sodium bromide, potassium iodide and sodium iodide, water softener such as amino polycarboxylic acid, polystyrene sulfonic acid and polyphosphonic acid, thickening agent such as ethylene glycol, diethylene glycol, diethanolamine and triethanolamine and various development accelerators. Furthermore, various additives made of such compounds as, for example, nitrobenzimidazole, mercaptobenzimidazole, 5-methyl benzotriazole and/or 1-phenyl-5-mercaptotetrazole, anti-stain compounds and anti-sludge compounds may also be used.

In addition to the developing agent, the developer compositions of this invention includes an oxidation-inhibiting amount of a poly(alkyleneimine). More specifically, the developing compositions of this invention include one or more antioxidants of formula (I) shown below.

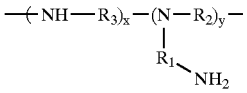

(I)

wherein $R_1$, $R_2$ and $R_3$ independently represent an unsubstituted or substituted alkylene group or $R_2$ may be H;

x and y independently represent an integer from 1 to 39,999;

the sum of x and y represents an integer from 10 to 40,000; and wherein the amine groups of the antioxidant have been partially oxidized with hydrogen peroxide or a compound capable of generating hydrogen peroxide, prior to the introduction of the developing agent.

In a preferred embodiment, the sum of x and y in the formula represents an integer in the range from 500 to 40,000. In a more preferred embodiment, the sum of x and y in the formula represents an integer in the range from 1,000 to 40,000.

The alkylene groups may be unsubstituted or substituted, for example, with one or more hydroxy, carboxy or sulfo groups, or with one or more unsubstituted or substituted alkyl groups, such as a methylhydroxy group. Preferably at least one of the alkylene groups is so substituted. The term alkylene groups, is intended to include alkylene groups that may contain a carbonyl linkage, an ether linkage, a double bond or other similar bond or linkage. The alkylene group may also comprise a cyclic structure. Preferably at least one of $R_2$ and/or $R_3$ is an ethylene group such that the antioxidant is a polyethyleneimine.

Antioxidants preferred for use in the present invention include but are not limited to:

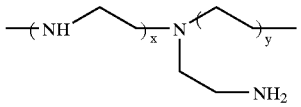

I-1

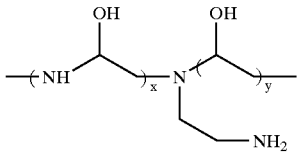

I-2

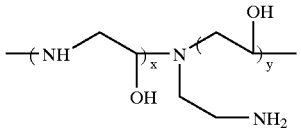

I-3

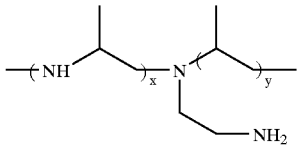

I-4

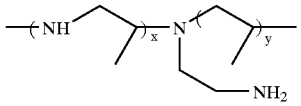

I-5

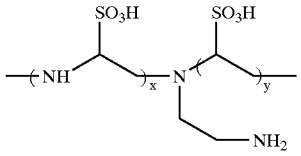

I-6

-continued

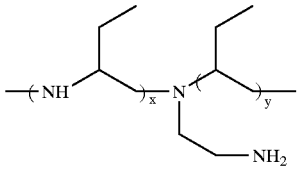

I-7

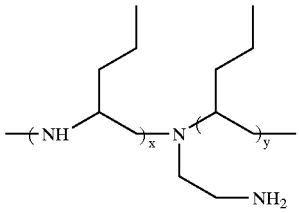

I-8

Exemplary synthesis methods of polyalkyleneimines are known in the art and have been disclosed in various documents, such as p.271 of Journal of Polymer Science, Polymer Symposia No. 56 (1976), p.108 of Macromolecules No. 5 (1972), p.958 of No. 7 of same (1974), p.435 of No. 11 of same (1978), p. 35 of Polymer Journal No. 3 (1972), p. 2609 of Journal of the American Chemical Society No. 82 (1960) and Japanese Patent Publication No. 18733/1988. Polyalkyleneimines can be synthesized by, for example, the method described in p.2609 of Journal of the American Chemical Society No. 82 (1960). In the same manner, branched poly(N-hydroxylalkyleneimine) may be obtained by oxidizing branched polyalkyleneimine, which can be synthesized by, for example, the method described in p.1301 of Journal of Macromolecular Science Chemistry No. A4 (1970).

The polyalkyleneimine antioxidant of the present invention may be made by partially oxidizing the antioxidant with hydrogen peroxide or a compound capable of generating hydrogen peroxide. Compounds capable of releasing hydrogen peroxide include metal peroxides, such as alkali metal peroxides, alkali metal perborates, alkali metal percarbonates, alkali metal perphosphates or alkali metal persulfates; compounds which include hydrogen peroxide in their crystal structure such as sodium percarbonate; other peroxy compounds such as sodium perborate and persulfate; or soluble organic peroxides, such as butyl peroxide or benzyl peroxide, or complexes, such as, for example, an urea:peroxide complex.

The polyalkyleneimine antioxidant can be dissolved in water and treated with hydrogen peroxide or a compound capable of releasing hydrogen peroxide. The mixture may be allowed to stand at room temperature (10–40° C.) for complete reaction to take place. Preferably, the mixture is allowed to stand for at least half an hour, more preferably from half an hour to 6 h, and most preferably for 1 h.

The amino groups of the antioxidant are partially oxidized, preferably such that the amount of hydroxylammonium groups formed is less than 50%, (but at least 1%), of the total equivalent of the original amine before the addition of the colour developing agent. That is, hydrogen peroxide is added, as hydrogen peroxide itself or a compound capable of forming hydrogen peroxide, at such a concentration to oxidize less than one half of the amine groups present in the alkyleneimine polymer. As hydrogen peroxide is capable of oxidizing two amine groups to a hydroxylamine, less than ¼ equivalent of the total number of amine groups of hydrogen peroxide of the amine groups should be added. Preferably, the amine groups of the antioxidant have been partially oxidized such that the amount of hydroxylammonium groups formed is less than 25% of the total equivalent of the amine groups of the antioxidant before the introduction of the developing agent.

By restricting the amount of peroxide used to oxidise the alkyleneimine polymer, the cost of the chemical used to prepare the antioxidant may be reduced. By carrying out the partial oxidation at room temperature instead of 60° C. as taught by the prior art, the energy requirement for the manufacture of the solution may be reduced, thus reducing the energy cost and effect on the environment ('global warming'). If any peroxide remains after the oxidation, it is likely to have an effect on process sensitometry, causing unexpected or uncontrolled redox amplification.

One of the advantages of using antioxidants based on long polymer chains such as an alkyleneimine polymer is that they are slow to diffuse into the gelatin matrix of the film. If they cannot get to the site of development during the development step of the process and dye formation, they cannot interfere with this reaction. If the polymer is completely oxidized, there is a risk that the polymer chains will be broken resulting in the formation of small active molecules that can affect the dye-forming processes. If the oxidization is restricted, the likelihood of forming these small potentially interfering species is much reduced.

It has been found that it is possible to partially oxidise the alkyleneimine polymer antioxidant and then, after the requisite delay, add the remaining chemical to complete the manufacture of the developer. In this way only one vessel is required to complete the manufacture. This reduces the amount of vessels, the rinsing of the vessels at the end of the preparation and reduces floor space, thus making manufacture easier and can make it less costly.

In one preferred embodiment, the developer may further comprise an alkaline buffer. Buffering agents are generally present in the developing compositions of this invention to provide or maintain desired alkaline pH of from 7 to 13, preferably from 8 to 12. These buffering agents must be soluble in the organic solvent described herein and have a pKa of from 9 to 13. Such useful buffering agents include, but are not limited to carbonates, borates, tetraborates, glycine salts, triethanolamine, diethanolamine, phosphates and hydroxybenzoates. Alkali metal carbonates, such as sodium carbonate, sodium bicarbonate and potassium carbonate are preferred buffering agents. Mixtures of buffering agents can be used if desired.

In addition to buffering agents, the pH can also be raised or lowered to a desired value using one or more acids or bases. It may be particularly desirable to raise the pH by adding a base, such as a hydroxide, for example, sodium hydroxide or potassium hydroxide.

The compositions of this invention may also include one or more of a variety of other addenda that are commonly used in photographic developing compositions, including alkali metal halides, such as potassium chloride, potassium bromide, sodium bromide and sodium iodide, auxiliary co-developing agents, such as phenidone type compounds particularly for black-and-white developing compositions, antifoggants, development accelerators, optical brighteners, such as triazinylstilbene compounds, wetting agents, fragrances, stain reducing agents, surfactants, defoaming agents, and water-soluble or water-dispersible colour couplers, as would be readily understood by one skilled in the art, see Research Disclosure, Item 38957, September 1996, published by Kenneth Mason Publications, Ltd., Dudley Annex, 12a North Street, Emsworth, Hampshire P010 7DQ, ENGLAND. The amounts of such additives are also well known in the art.

The compositions of this invention may also include one or more of a variety of photographically inactive, water-miscible or water-soluble, straight-chain organic solvents that are capable of dissolving developing agents in their free base forms. Such organic solvents can be used singly or in combination, and preferably each has a molecular weight of from about 50 to about 200, preferably from 100 to 150. Such preferred solvents generally have from 2 to 10 carbon atoms, preferably from 2 to 6 carbon atoms, and more preferably from 4 to 6 carbon atoms, and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

The developer of the present invention may be made by partially oxidizing a polyalkyleneimine antioxidant with hydrogen peroxide or a compound capable of generating hydrogen peroxide and mixing said partially oxidized polyalkyleneimine antioxidant with a developing agent. In one embodiment, the composition may be formulated by mixing a suitable developing agent with the partially oxidised antioxidant in aqueous or solid form, and is preferably prepared as an aqueous composition by diluting a single-part concentrate. Alternatively, the composition of this invention may be prepared by mixing all of the desired components in any desired order at working strength concentrations, provided that the developing agent is added after the partial oxidation of the polyalkyleneimine.

Black-and-white developing compositions of this invention can be used to process any suitable black-and-white photographic silver halide element, including graphics, aerial photography and amateur and professional black-and-white photographic negative and reversal films and papers. In addition, they can be used as the developing composition in the "first development" step used to process colour reversal photographic films.

The first developing step is usually carried out using a conventional black-and-white developing solution that can contain black-and-white developing agents, auxiliary co-developing agents, preservatives, antifoggants, anti-sludging agents, buffers and other conventional addenda. Useful first developing compositions are described for example, in U.S. Pat. Nos. 5,298,369 and 5,552,264.

The developing compositions of this invention have utility to provide development in an imagewise exposed photographic silver halide element comprising a support and one or more silver halide emulsion layers containing an imagewise distribution of developable silver halide emulsion grains. A wide variety of types of photographic elements, including especially colour films and papers, and colour motion picture films and prints, containing various types of emulsions can be processed using the present invention, the types of elements being well known in the art (see Research Disclosure, Item 38957). In particular, the invention can be used to process colour photographic papers of all types of emulsions, including so-called "high chloride" and "low chloride" type emulsions, and so-called tabular grain emulsions as well. The colour developer solution can also be used in colour reversal processing of colour reversal films and papers.

Colour photographic papers comprising both high and low chloride emulsions can have any useful amount of silver coated in the one or more emulsions layers, and in some embodiments, elements having low silver, that is, less than 0.8 g silver/$m^2$, more preferably less than 0.3 g silver/$m^2$, are processed with the present invention.

The layers of the photographic elements can have any useful binder material or vehicle as it known in the art, including various gelatins and other colloidal materials.

Development of an imagewise exposed photographic silver halide element is carried out by contacting the element with the developing composition of this invention under suitable time and temperature conditions, in suitable processing equipment, to produce the desired developed image. Additional processing steps can then be carried out using conventional procedures, including but not limited to, one or more development, stop, bleaching, fixing, bleach/fixing, washing or rinsing, stabilizing and drying steps in any particular desired order as would be known in the art. Useful processing steps, conditions and materials useful therefore are well known for the various processing protocols including the conventional Process C-41™ processing of colour negative films, Process RA-4™ for processing colour papers and Process E-6™ for processing colour reversal films (see for example, Research Disclosure, Item 38957).

The photographic elements processed in the practice of this invention can be black-and-white or single or multilayer colour elements. Multilayer colour elements typically contain dye image-forming units sensitive to each of the three primary regions of the visible spectrum. Each unit can comprise a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components and suitable methods of processing various types of elements are described in the Research Disclosure, noted above. Included within such teachings in the art is the use of various classes of cyan, yellow and magenta colour couplers that can be used with the present invention, including pyrazolone and pyrazolotriazole magenta dye-forming couplers. In addition, the present invention can be used to process colour photographic papers having pigmented resin-coated paper supports which are prepared with the usual internal and external sizing agents, including alkylketene dimers and higher fatty acids, strengthening agents and other known paper additives and coatings.

Representative commercial colour papers that are useful in the practice of this invention include, but are not limited to, KODAK EKTACOLOUR™ EDGE V, VII and VIII Colour Papers (Eastman Kodak Company), KODAK ROYAL™ VII Colour Papers (Eastman Kodak Company), KODAK PORTRA™ III, IIIM Colour Papers (Eastman Kodak Company), KODAK SUPRA III and IIIM Colour Papers (Eastman Kodak Company), KODAK ULTRA III Colour Papers (Eastman Kodak Company), FUJI SUPER Colour Papers (Fuji Photo Co., FA5, FA7 and FA9), FUJI CRYSTAL ARCHIVE and Type C Colour Papers (Fuji Photo Co.), KONICA COLOUR QA Colour Papers (Konica, Type QA6E and QA7) and AGFA TYPE II and PRESTIGE Colour Papers (AGFA). The compositions and constructions of such commercial colour photographic elements would be readily determined by one skilled in the art.

KODAK DURATRANS™, KODAK DURACLEAR, KODAK EKTAMAX™ RAL and KODAK DURAFLEX™ photographic materials and KODAK Digital Paper Type 2976 can also be processed using the present invention. The compositions and constructions of such commercial colour photographic elements could be readily determined by one skilled in the art.

Colour negative films that can be processed using the compositions of this invention include, but are not limited to, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTIX™ films, FUJI SUPER G Plus films, FUJI SMARTFILM™ products, FUJICOLOUR NEXIA™ films, KONICA VX films, KONICA SRG3200 film, 3M SCOTCH ATG films and AGFA HDC and XRS films. Films processed according to this invention can also be those incorporated into what are known as "single-use cameras".

The elements are typically exposed to suitable radiation to form a latent image and then processed to form a visible dye and/or silver image. In colour photographic processing, processing includes the step of colour development in the presence of a colour developing agent to reduce developable silver halide and to oxidize the colour developing agent. Oxidized colour developing agent in turn reacts with a colour-forming coupler to yield a dye.

The developing composition of this invention can also be used in what are known as redox-amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al) and publications noted therein.

For colour processing, colour development is generally followed by a bleaching or bleach/fixing step using a suitable silver bleaching agent. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylene-diaminetetraacetic acid and others described in Research Disclosure, Item 38957, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid, such as methyliminodiacetic acid, ethylenediaminedisuccinic acid and similar compounds as described in EP-A-0 532 003 and ethylenediamine monosuccinic acid and similar compounds as described in U.S. Pat. No. 5,691,120 (Wilson et al).

The processing time and temperature used for each processing step of the present invention are generally those conventionally used in the art. For example, development is generally carried out at a temperature of from 20 to 60C. The overall processing time can be up to 30 min., and preferably less than 450 s. Overall development times of at least 60 s are generally used for processing colour photographic papers.

The following examples are provided to illustrate the invention but are in no way intended to limit the scope thereof.

EXAMPLE 1

Sensitometric Tests:

300 mm×35 mm strips of Kodak™ Edge 8 Papers, which are colour negative-working silver halide reflective print media on resin coated cellulose based paper, were exposed on a DF1 sensitometer with an exposure time of 1/10 s through a 2B filter. The wedge used was 0.15 log E.

The process times were:

| | | |
|---|---|---|
| Developer | 45 s | 37.8° C. |
| Bleach Fix | 45 s | 37.8° C. |
| Wash | 120 s | 35–40° C. |

Dry at room temperature using the following solutions:

Developer Solution(Comparison):

| | |
|---|---|
| diethylhydroxylamine (DEHA)(85%) | 4 g/l |
| Phorwite ™ REU optical brightener | 0.812 g/l |
| Versa ™ TL surfactant | 0.120 g/l |
| Lithium sulfate | 1.40 g/l |
| Magnesium sulfate heptahydrate | 0.14 g/l |
| Potassium sulfite (45%) | 0.58 g/l |
| Potassium carbonate (50%) | 41.2 g/l |
| Dequest ™ 2066 (60%) | 0.6 g/l |
| Potassium bromide | 0.03 g/l |
| Potassium chloride | 4.7 g/l |
| 4-(N-ethyl-N-2-methanesulfonylaminoethyl)-2-methylphenylenediamine sesquisulfate (CD3) | 4.76 g/l |

The pH was adjusted to 10.10±0.03 at 25C with 50% potassium hydroxide solution or concentrated sulfuric acid.

For the invention, the DEHA was replaced with 10 g/l 50% EIP polymer, manufactured by Fluke, with a molecular weight range of from 600,000 to 1,000,000. Before the CD3 was added, 10 ml/l 3% hydrogen peroxide was added and the mixture allowed to stand after stirring for 1 h. The CD3 was added after the standing time. The number of equivalents of amine function in the EIP is approximately 500/44×10/1000=0.114 mol/l (10 ml/l of the original 500 g/l (50%) solution of polymer with a unit molecular weight of 44). The amount of peroxide added is 30/34×10/1000=0.0088 mol/l (10 ml/l of the original 30 g/l (3%) solution of hydrogen peroxide with a unit molecular weight of 34). Assuming a peroxide molecule can oxidise two molecules of the amine, the amount of amine functions oxidized is 0.0088×2/0.114×100=15.4% oxidized. The extent of oxidation may be marginally less as a result of side reaction, which may reduce the extent of oxidation.

Bleach-fix Solution:

Kodak EktaColour™ Prime Bleach-fix was made up as recommended. Strips processed in the comparison and invention developers were compared. The results are shown in FIG. 1. The results suggest that the invention using EIP has similar sensitometry to the control containing DEHA.

EXAMPLE 2

Figure 2:
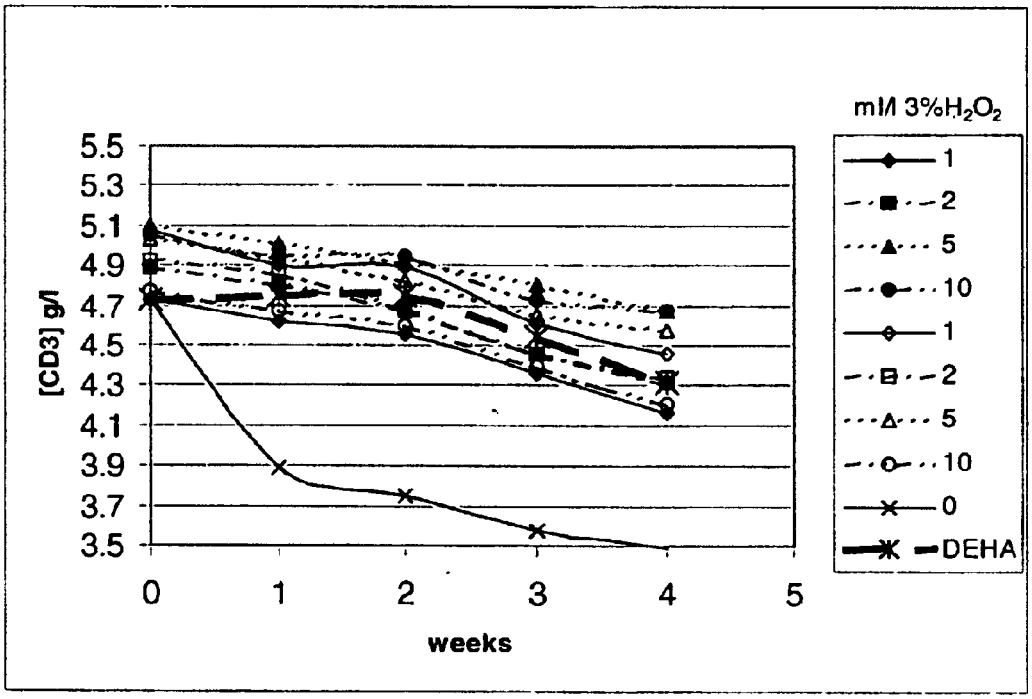
FIG. 2 represents a graph of the rate of loss of CD3 in a number of solutions stabilized with EIP without peroxide added and with various amounts of 3% peroxide, the solid and dotted lines representing respectively runs wherein CD3 is added 1 h and 6 h after the peroxide.

Keeping Tests:

800 ml of the developer solution used in the sensitometry experiment without CD3 or antioxidant was taken and poured in to a wide-necked 11 bottle. Antioxidant was added and 4 g/l DEHA (comparison) or 10 g/l EIP, followed by an amount of 3% hydrogen peroxide solution, as shown in the key of FIG. 2. This solution was held for times of 1 h and 6 h, after which longer time it was assumed that the amine group oxidation would be complete. CD3 was then added at a concentration of 4.76 g/l, the solutions were mixed thoroughly and the pH was adjusted to 10.1. The developers were then left to stand in air. Once weekly, the developer solutions were stirred and a 2 ml sample taken from each solution for CD3 analysis by HPLC. Evaporation was considered and after each sample was taken the bottle was marked with the new level. When the next sample was taken, water was used to top the developer up to the previously marked level hence replacing the water lost though evaporation. The bottle was marked to the new level, after sampling.

The results are shown in FIG. 2. The results for adding CD3 after 1 h after adding the peroxide are shown as a solid line and the dotted line represents the results from the runs with a 6 h delay before the addition of the developing agent. It may be seen from the results that adding peroxide even at very low concentrations prevents the initial rapid loss of CD3, as shown by the bottom curve representing the case where no peroxide was added. The EIP with peroxide behaves very similarly to the comparison antioxidant, DEHA, with respect to sensitometry, but without the smell.

EXAMPLE 3

Figure 3:
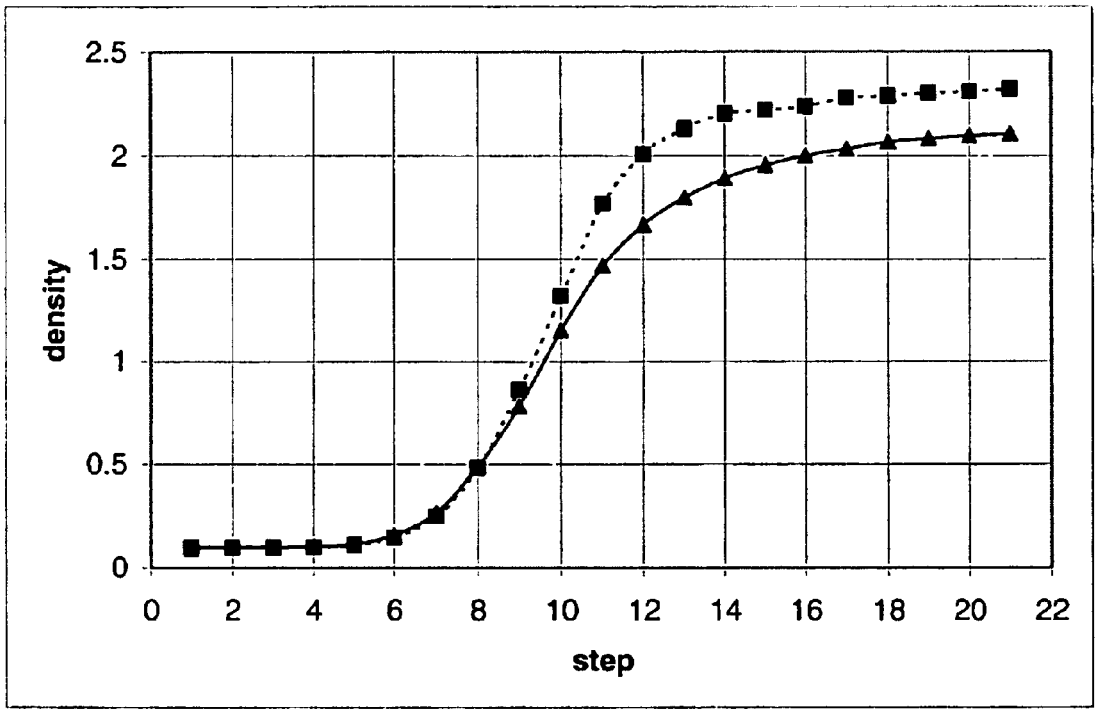
FIGS. 3, 4 and 5 represent respectively, comparisons of the loss in dye density, "Red off the Neutral", "Green off the Neutral" and "Blue off the Neutral", as a function of the degree of treatment of EIP with peroxide. The curves including triangles in each case represent fully oxidised EIP whilst the curves including squares represent in each case the partially oxidised EIP.
Figure 4:
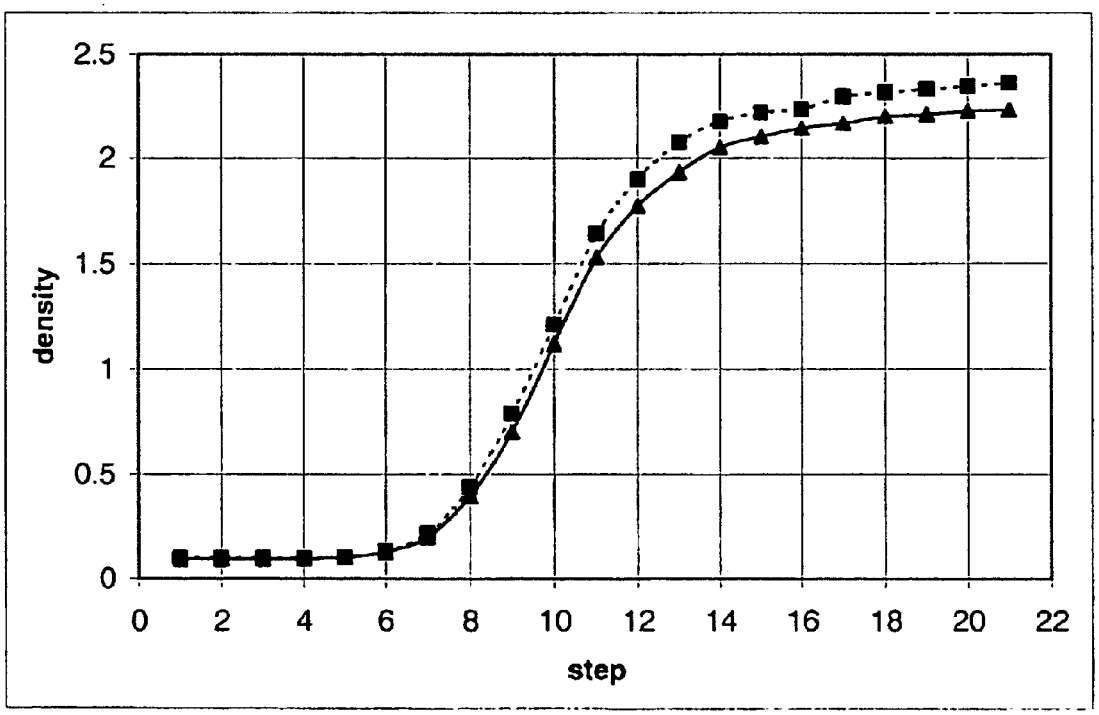
Figure 5:
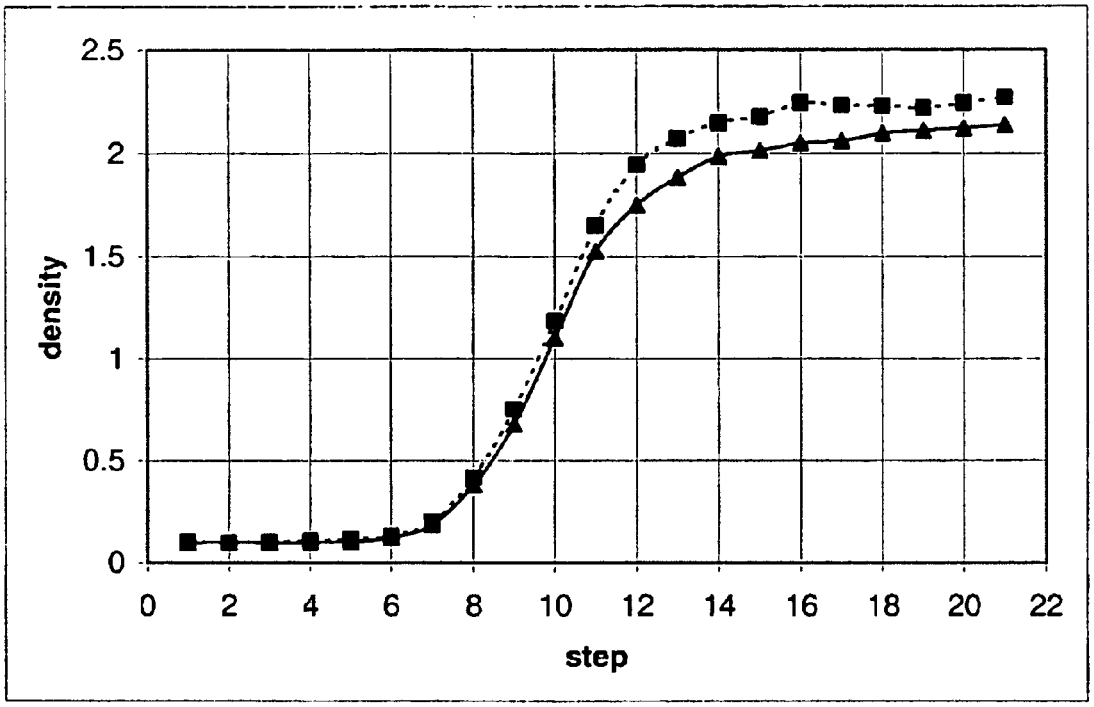

An attempt was made to make fully oxidized EIP in a similar way to that described in the prior art, U.S. Pat. No. 5,466,565. 50 g EIP was dissolved in 800 ml water. 60 g 30% hydrogen peroxide was dripped into this over a 15 min. period. The mixture was warmed to 60C for 1 h and then cooled. The DEHA used in the developer in Example 1 was replaced with 100 ml/l of the above solution, allowance being made for the extra water when making the developer. The sensitometry was compared to the developer containing 10 ml/l (same concentration as the 100% oxidized EIP because of dilution in the preparation) EIP (15.4% oxidized), using the method of Example 1. The results are shown in FIGS. 3, 4 and 5. From these results, it can be seen that the fully oxidized material, represented by the curves including triangles, causes a loss in dye density in all three layers and especially in the red layer suggesting that the fully oxidized species is interfering with development or dye formation.

The invention has been described in detail with particular reference to certain preferred embodiments thereof, but it will be understood that variations and modifications can be effected within the spirit and scope of the invention.

What is claimed is:

1. A developer comprising a developing agent and a polyalkyleneimine antioxidant being formed by the condensation of a number of alkyleneimine units and having the following formula (I):

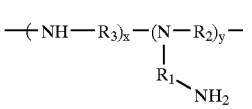

(I)

wherein $R_1$, $R_2$ and $R_3$ independently represent an unsubstituted or substituted alkylene group or $R_2$ may be H;

x and y independently represent an integer from 1 to 39,999;

the sum of x and y represents an integer from 10 to 40,000; and wherein the amine groups of the antioxidant have been partially oxidized with hydrogen peroxide or a compound capable of generating hydrogen peroxide prior to introduction of said developing agent.

2. A developer as claimed in claim 1 wherein at least one of $R_2$ and/or $R_3$ is an ethylene group such that the compound of formula (I) is a polyethyleneimine.

3. A developer as claimed in claim 1 wherein at least one of the alkylene groups is substituted with at least one member selected from the group consisting of a hydroxy group, a carboxy group or a sulfo group or with one or more unsubstituted or substituted alkyl groups.

4. A developer as claimed in claim 1 wherein at least one of the alkylene groups comprises a cyclic structure.

5. A developer as claimed in claim 1 wherein the sum of x and y in the formula represents an integer in the range from 500 to 40,000.

6. A developer as claimed in claim 5 wherein the sum of x and y in the formula represents an integer in the range from 1,000 to 40,000.

7. A developer as claimed in claim 1 wherein the developer comprises a colour developer.

8. A developer as claimed in claim 1 wherein the amine groups of the antioxidant have been partially oxidized to form hydroxylammonium groups, such that the amount of hydroxylammonium groups formed is less than half the total equivalent of the amine groups of the antioxidant before the introduction of the developing agent.

9. A developer as claimed in claim 8 wherein the amine groups of the antioxidant have been partially oxidized to form hydroxylammonium groups such that the amount of hydroxylammonium groups formed is less than one quarter of the total equivalent of the amine groups of the antioxidant before the introduction of the developing agent.

10. A developer as claimed in claim 1 wherein the amine groups of the antioxidant have been oxidized for at least half an hour before the introduction of the developing agent.

11. A developer as claimed in claim 1 wherein the compound capable of generating hydrogen peroxide comprises at least one member selected from the group consisting of hydrogen peroxide, alkali metal peroxides, alkali metal perborates, alkali metal percarbonates, alkali metal perphosphates, alkali metal persulfates, organic peroxides or urea:peroxide complexes.

12. A developer as claimed in claim 1 wherein the developing agent comprises at least one member selected from the group consisting of a p-phenylenediamine, a hydroquinone, an aminophenol, a pyrazolidinone, a sulfonhydrazide or a hydrazine.

13. A developer as claimed in claim 1 which also comprises an alkaline buffer.

14. A method of making a developer comprising partially oxidizing the amine groups of a polyalkyleneimine antioxidant with hydrogen peroxide or a compound capable of generating hydrogen peroxide and mixing said antioxidant with a developing agent, said polyalkyleneimine antioxidant having been formed by the condensation of a number of alkyleneimine units and having the following formula (I):

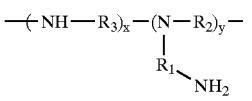

(I)

wherein $R_1$, $R_2$ and $R_3$ independently represent an unsubstituted or substituted alkylene group or $R_2$ may be H;

x and y independently represent an integer from 1 to 39,999;

the sum of x and y represents an integer from 10 to 40,000.

* * * * *